US005739829A

United States Patent [19]

Loyd

[11] Patent Number: 5,739,829

[45] Date of Patent: Apr. 14, 1998

[54] BUBBLE FLOW DETECTION

[75] Inventor: John C. Loyd, Centerville, Ohio

[73] Assignee: Scitex Digital Printing, Inc., Dayton, Ohio

[21] Appl. No.: 640,103

[22] Filed: Apr. 30, 1996

[51] Int. Cl.[6] ..... B41J 2/185

[52] U.S. Cl. ..... 347/17; 347/73; 347/90

[58] Field of Search ..... 347/6, 17, 84, 347/85, 89, 90, 92, 73, 78, 81; 73/861.41

[56] References Cited

U.S. PATENT DOCUMENTS

| | | | |
|---|---|---|---|
| 4,639,738 | 1/1987 | Young et al. | 347/89 |
| 4,811,035 | 3/1989 | Huliba et al. | 347/89 |
| 4,837,585 | 6/1989 | Williams et al. | 347/89 |
| 4,929,966 | 5/1990 | Sexton et al. | 347/90 |

FOREIGN PATENT DOCUMENTS

| | | | |
|---|---|---|---|
| 61-19369 | 1/1986 | Japan | 347/90 |

*Primary Examiner*—John E. Barlow, Jr.
*Attorney, Agent, or Firm*—Barbara Joan Haushalter

[57] ABSTRACT

A fluid flow detection method is used in a continuous ink jet printer which generates a row of parallel selectively charged drop streams from a fluid system. In the fluid flow detection method, a low airflow catcher device is provided for establishing bubble flow in an associated catcher vacuum port and catcher return line. The catcher return line contains catcher return fluid. Pressure fluctuations are monitored in the catcher return fluid to the ink tank, the ink tank having a tank vacuum. The tank vacuum is automatically lowered to a preset value, which preset value is greater than bubble flow transition. The tank vacuum is then incrementally lowered as pressure fluctuations are monitored. The tank vacuum is maintained at a constant level when the pressure fluctuations decrease below a predetermined level due to the establishment of bubble flow. Finally, the fluid flow detection method requires increasing the tank vacuum by a predetermined increment and maintaining that tank vacuum as the operating point for bubble flow for the printer.

5 Claims, 2 Drawing Sheets

BUBBLE FLOW DETECTION

TECHNICAL FIELD

The present invention relates to continuous ink jet printing systems and, more particularly, to the detection of the fluid flow regime in the catcher vacuum port and catcher return line to the ink tank of continuous ink jet printing systems.

BACKGROUND ART

In continuous ink jet printing, electrically conductive ink is supplied under pressure to a manifold region that distributes the ink to a plurality of orifices, typically arranged in a linear array(s). The ink discharges from the orifices in filaments which break into droplet streams. Individual droplet streams are selectively charged in the region of the break off from the filaments and charged drops are deflected from their normal trajectories. The deflected drops may be caught and recirculated, and the undeflected drops allowed to proceed to a print medium.

A charge plate, comprising an array of addressable electrodes, is located proximate to stream break-off points to induce an electrical charge, selectively, on adjacent droplets, in accord with print information signals. Charged droplets are deflected from their nominal trajectory. For example, in a common, binary, printing mode, charged or non-print droplets are deflected into a catcher device and non-charged droplets proceed to the print medium.

Current catcher devices do not have a means for detecting the type of fluid flow, or flow regime, in the catcher vacuum port and the catcher return line. The flow is simply established by setting the tank vacuum at a specified value and allowing the system characteristics to govern the type of fluid flow.

In co-pending, commonly assigned patent application Ser. No. 08/640,237, totally incorporated herein by reference, a low airflow catcher is disclosed, which establishes bubble flow in the catcher port and catcher return line. Bubble flow is established by decreasing the tank vacuum below a certain threshold level. However, the tank vacuum threshold level for bubble flow varies from printer to printer. Furthermore, a fixed vacuum level may be too high or too low in relation to the threshold level for bubble flow for a particular printer, due to the printer to printer variations.

It would be desirable, therefore, to have a means of detecting bubble flow, rather than simply setting the tank vacuum to a fixed level for all printers.

SUMMARY OF THE INVENTION

This need is met by the fluid flow regime detection apparatus, according to the present invention, wherein a fluid flow regime in the catcher vacuum port and catcher return line to the ink tank is detected. A sudden decrease in pressure fluctuations in the catcher return fluid is used to detect the establishment of bubble flow in the catcher vacuum port and the catcher return line.

In accordance with one aspect of the present invention, a fluid flow detection method is used in a continuous ink jet printer. In the fluid flow detection method, a low airflow catcher device is provided for establishing bubble flow in an associated catcher vacuum port and catcher return line. The catcher return line contains catcher return fluid. Pressure fluctuations are monitored in the catcher return fluid to the ink tank, the ink tank having a tank vacuum. The tank vacuum is automatically lowered to a preset value, which preset value is greater than bubble flow transition. The tank vacuum is then incrementally lowered as pressure fluctuations are monitored. The tank vacuum is maintained at a constant level when a magnitude of the pressure fluctuations decreases below a predetermined level due to the establishment of bubble flow. Finally, the fluid flow detection method requires increasing the tank vacuum by a predetermined increment and maintaining that tank vacuum as the operating point for bubble flow for the printer.

Accordingly, it is an object of the present invention to provide for continuous ink jet printing, a fluid flow regime detection system and method. It is a further object of the present invention to provide such a detection means for the catcher vacuum port and catcher return line to the ink tank.

Other objects and advantages of the invention will be apparent from the following description, the accompanying drawings and the appended claims.

DETAILED DESCRIPTION OF THE PREFERRED EMBODIMENTS

One significant purpose of the present invention is to provide detection of the fluid flow regime in the catcher vacuum port and catcher return line to the ink tank for a low airflow catcher apparatus which establishes bubble flow in these areas.

Figure 1:
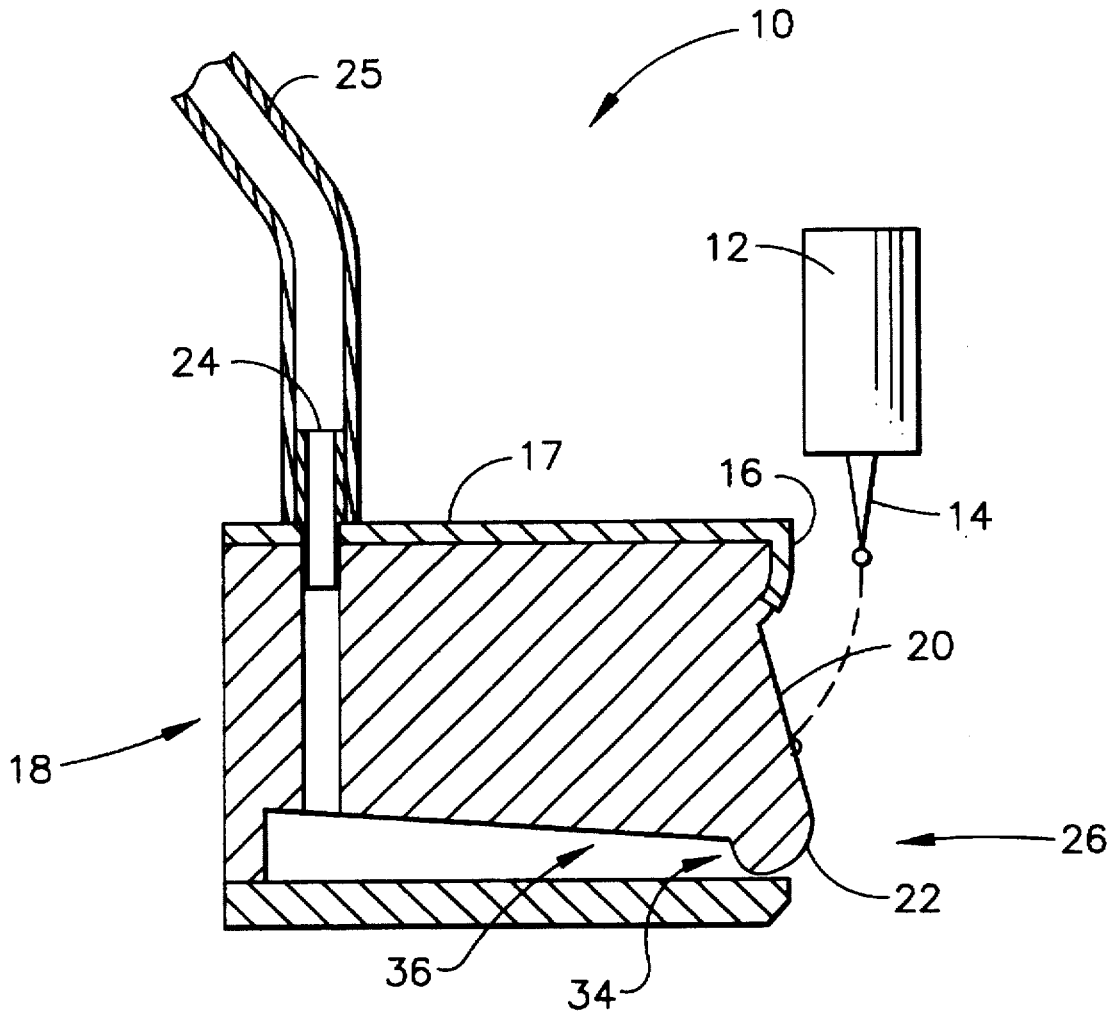
FIG. 1 is a schematic side view of an ink jet printhead useful with the fluid flow regime detection in accordance with the present invention.

Referring to the drawings, a schematic side view of an ink jet printhead of the type employed with the present invention is shown in FIG. 1. The printhead, generally designated 10, includes a resonator assembly 12 having an ink manifold and orifice plate (not shown) for generating filaments of ink 14. The resonator stimulates the filaments to break off into droplets in the region of charging electrodes 16 on a catcher assembly generally designated 18. Drops of ink are selectively charged by the charging electrodes and deflected onto a catcher face 20 and into a catcher throat 22. Uncharged drops proceed undeflected to a print medium (not shown). Collected ink is withdrawn through a catcher tube 24 and is recirculated.

Referring now to FIG. 1, a catcher vacuum port 26 returns unprinted ink to the fluid system. The vacuum port comprises catcher face 20, a radius, and catcher throat 22. The catcher face 20 receives selectively charged drops of ink and the catcher radius directs the flow of selectively charged drops of ink from the catcher face into the catcher throat. The unprinted drops from the array of ink jets impact on the face 20 of the catcher, creating a film of ink attached to the face. Due to momentum from the impacting drops, the ink film flows toward the radius. The film remains attached to the catcher even as it flows around the radius and along the surface toward the throat opening. The catcher throat 22 accepts the flow of selectively charged drops of ink from the catcher face. In the throat, air is ingested along with the ink and, depending upon the vacuum level in the ink tank, either slug flow or bubble flow is established downstream of the throat.

As illustrated in FIG. 1, the throat 22 comprises a short, narrow gap 34 with a sudden enlargement 36, downstream of the gap, and converging-diverging passages, all of which together govern the ingested airflow. The flow continues to the catcher tube 24 where it is pulled away through an attached catcher return line 25.

Various factors vary from printer to printer which affect the threshold vacuum level for bubble flow. For instance, the flow characteristics of the catcher return line are different for the two optional lengths of twelve feet and twenty-four feet. Furthermore, the flow characteristics of the catcher vacuum port vary from catcher to catcher. Finally, the fluid characteristics vary from one ink type to another.

Additionally, a fixed vacuum level may be too high or too low in relation to the threshold level for bubble flow for a particular printer, due to the printer to printer variations. For example, if the level is too high, bubble flow will not be established, and the benefits of bubble flow will not be realized. Conversely, of the level is too low, although bubble flow is established, the ink will not be removed from the printhead fast enough. An ink spill and damage to the printhead may occur as a result. The ideal vacuum setting, then, is the vacuum at which bubble flow is first established as the tank vacuum is lowered. This is the highest vacuum at which bubble flow can be established. Then there is no danger of the vacuum being too low to return ink from the printhead.

Figure 2:
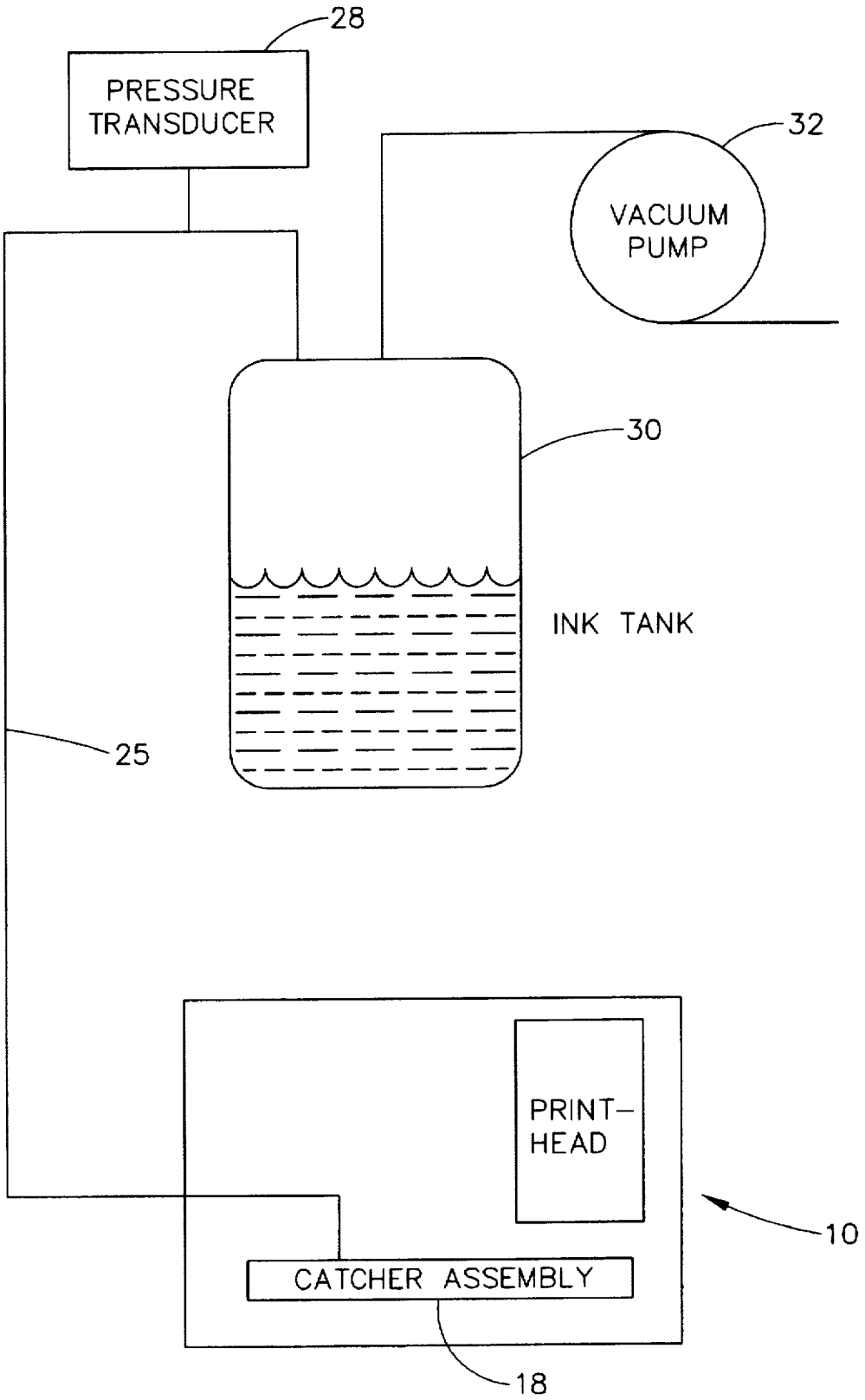
FIG. 2 illustrates the catcher vacuum port and catcher return line to the ink tank, for which fluid flow regime is detected in accordance with the present invention.

Therefore, in accordance with the present invention, a sudden decrease in a magnitude of pressure fluctuations in the catcher return fluid is used to detect the establishment of bubble flow in the catcher vacuum port and the catcher return line. Continuing with FIG. 2, a pressure transducer 28, in the catcher return line 25 near ink tank 30 end, is used to monitor pressure fluctuations in the catcher return fluid.

When the printhead is first in the catch condition, an initially high vacuum level in the tank, established by vacuum pump 32, establishes slug flow, in which frothy slugs of ink travel at a much higher rate than the average liquid velocity, in the catcher vacuum port and the catcher return line. Very wide swings in pressure are associated with slug flow as the frothy slugs and liquid alternately travel past the pressure transducer. The tank vacuum is lowered automatically to a preset value, depending upon the catcher line length, that is still well above the bubble flow transition point for that length. The tank vacuum is then lowered from this point, preferably in pressure steps of five inches of water. At each step, the flow is allowed to stabilize and the pressure transducer monitored for indications of pressure fluctuations. If large magnitude pressure fluctuations are detected, the tank vacuum is lowered to the next step. This continues until the magnitude of the pressure fluctuations is reduced to a predetermined acceptable level.

As the tank vacuum is stepwise lowered, the slug flow suddenly transitions into the bubble flow regime. In this regime of two-phase flow; the ingested airflow is in the form of individual separate bubbles, rather than frothy slugs, which are entrained in the liquid phase and travel at the velocity of the liquid. Thus, bubble flow provides significantly reduced airflow and much less agitation than slug flow. The entrained bubbles traveling along with the liquid produce only small pressure fluctuations at the pressure transducer, which is being monitored for indications of large pressure fluctuations. The sudden decrease in the magnitude of the pressure fluctuations is interpreted by the fluid system control software as the establishment of bubble flow. The tank vacuum level is then increased an incremental amount, depending upon the catcher line length, to the operating point. This incremental increase provides an increased margin above the minimum acceptable vacuum level. The incremental increase is possible without reverting back to slug flow because of a hysteresis pattern in the flow characteristics for the catcher return system. The tank vacuum level at which transition between bubble flow and slug flow occurs depends upon the direction of change of the tank vacuum. For decreasing tank vacuum, the transition of slug flow to bubble flow occurs at a lower vacuum level; whereas for increasing tank vacuum, the transition from bubble flow to slug flow occurs at a higher vacuum level. Thus, once bubble flow is established, the vacuum level can be increased somewhat without reverting back to slug flow.

INDUSTRIAL APPLICABILITY AND ADVANTAGES

The present invention is useful in the field of ink jet printing, and has the advantage of providing a fluid flow detection system and method for detecting the fluid flow regime in the catcher vacuum port and catcher return line to the ink tank. It is a further advantage of the present invention that pressure fluctuations in the catcher return fluid can be monitored. It is yet another advantage of the present invention that the fluid flow regime in the catcher vacuum port and the catcher return line can be controlled by adjusting the tank vacuum until a certain flow regime is established, as indicated by the detected fluctuations.

The invention has been described in detail with particular reference to certain preferred embodiments thereof, but it will be understood that modifications and variations can be effected within the spirit and scope of the invention.

I claim:

1. In a continuous ink jet printer for generating a row of parallel selectively charged drop streams from a fluid system, a fluid flow detection method for detecting a fluid flow regime in a catcher vacuum port and a catcher return line to an ink tank of the continuous ink jet printer, the fluid flow detection method comprising the steps of:

providing a low airflow catcher device for establishing bubble flow in the catcher vacuum port and the catcher return line, the catcher return line containing catcher return fluid, by generating a tank vacuum in the ink tank;

monitoring pressure fluctuations in the catcher return fluid;

automatically lowering the ink tank vacuum to a preset value;

incrementally lowering the tank vacuum from the preset level as pressure fluctuations are monitored;

maintaining the tank vacuum at a constant level when a magnitude of the pressure fluctuations decreases below a predetermined level due to establishment of bubble flow; and increasing the tank vacuum by a predetermined increment and maintaining that tank vacuum as an operating point for bubble flow for the printer.

2. A fluid flow detection method as claimed in claim 1 wherein the step of automatically lowering the ink tank vacuum to a preset value further comprises the step of automatically lowering the ink tank vacuum to a preset value greater than bubble flow transition.

3. A fluid flow detection method as claimed in claim 1 wherein the catcher vacuum port comprises:

a catcher face;

a catcher radius; and a catcher throat.

4. A fluid flow detection method as claimed in claim 3 wherein the catcher throat comprises a short, narrow gap with a sudden enlargement downstream of the gap, and converging-diverging passages, to govern ingested airflow.

5. A fluid flow detection method as claimed in claim 3 wherein the catcher vacuum port returns unprinted ink to the fluid system.

* * * * *